US005860196A

United States Patent [19]

Murray, Jr.

[11] Patent Number: 5,860,196

[45] Date of Patent: Jan. 19, 1999

[54] GROMMET STRESS REDUCER

[76] Inventor: John H. Murray, Jr., 825 Canyon Ave., Cody, Wyo. 82414

[21] Appl. No.: 921,753

[22] Filed: Aug. 26, 1997

[51] Int. Cl.[6] ..... A44B 21/00; B42F 1/00

[52] U.S. Cl. ..... 24/459; 24/72.7; 24/522; 24/596; 24/713; 428/99; 428/131

[58] Field of Search ..... 24/459, 522, 596, 24/72.7; 248/99, 131

[56] References Cited

U.S. PATENT DOCUMENTS

| | | | |
|---|---|---|---|
| 1,070,996 | 8/1913 | Stingel . | |
| 1,729,153 | 9/1929 | Capen . | |
| 2,289,225 | 7/1942 | Tonai | 24/713 |
| 3,332,118 | 7/1967 | Temple et al. . | |
| 3,348,270 | 10/1967 | Mazor . | |
| 3,522,635 | 8/1970 | Nilsson . | |
| 4,175,305 | 11/1979 | Gillis | 24/459 |
| 4,588,191 | 5/1986 | Stewart . | |
| 4,757,662 | 7/1988 | Gasser | 24/459 |
| 5,415,915 | 5/1995 | Oh . | |
| 5,557,830 | 9/1996 | Davis | 24/459 |
| 5,692,272 | 12/1997 | Woods | 24/459 |

*Primary Examiner*—Victor N. Sakran
*Attorney, Agent, or Firm*—Chase & Yakimo, L.C.

[57] ABSTRACT

A device for reducing stress on a grommet of a flexible covering including a stress distributing member with a recess formed in the outer surface thereof and a connecting loop mounted on the member at the recess and extending outwardly therefrom. The stress distributing member forms a bar for reducing stress on an end or side grommet or forms a semi-circular wedge for reducing stress on a corner grommet. The recess is sized for receipt of a grommet therein and presents a rounded surface at its perimeter to prevent the grommet from becoming pinched or collapsing. The loop receives the securing rope or other tie therethrough. The force on the loop is distributed by the bar or wedge over an extended portion of the flexible covering. A combination of bar and wedge stress distributing members form a system for reducing stress on the plurality of grommets within a flexible covering.

16 Claims, 3 Drawing Sheets

Fig. 5
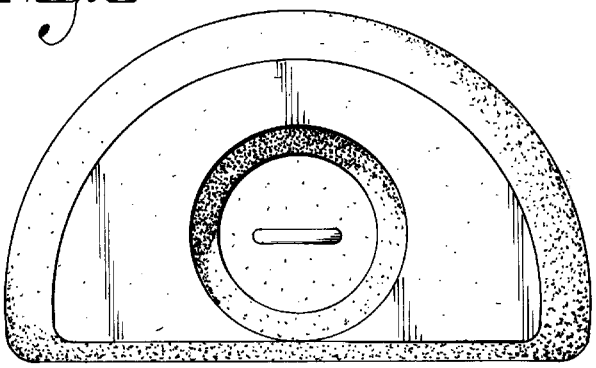
Fig. 6
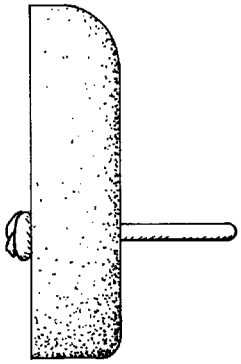
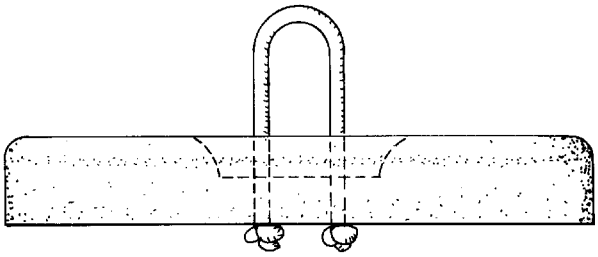
Fig. 7
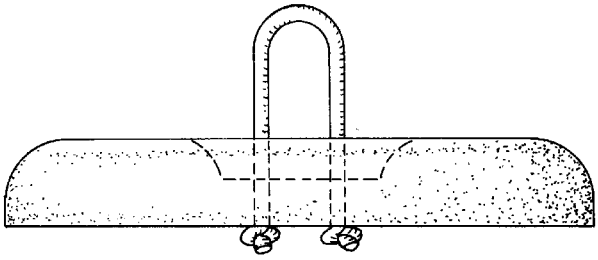
Fig. 8
Fig. 9
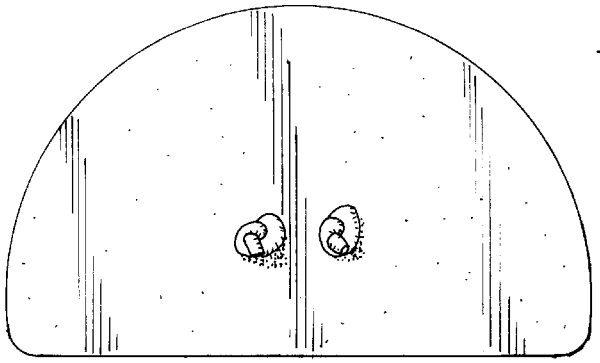

GROMMET STRESS REDUCER

FIELD OF THE INVENTION

This invention relates to a device that reduces stress on a grommet or reinforcing ring used at an anchoring hole at the edge of a tent, tarp or other flexible covering.

BACKGROUND OF THE INVENTION

The material of tents becomes severely stressed at each of the holes at which the tent is tied to a stake. Also, canvas covers or tarps, such as those used on trucks to cover a load, are pulled tight and secured using ropes or other ties at anchoring holes or eyes, and thus, these points are likewise subjected to high stress. In time, these protective covers often fail at the eyes or anchor holes because the grommet tears loose and the material fails.

SUMMARY OF THE INVENTION

Accordingly, a primary object of the subject invention is to provide a grommet stress reducer for use at an anchoring hole at the edge of a protective covering, such as a tent or tarp to prevent the grommet from separating from the tarp.

Another object of the subject invention is to provide a grommet stress reducer having a recess sized for receipt of a grommet therein.

Still another object of the subject invention is to provide a grommet stress reducer having a recess presenting a rounded surface at its perimeter.

Yet another object of the subject invention is to provide a grommet stress reducer that helps prevent the failure of a protective cover at its anchor holes.

Yet another object of the subject invention is to provide a grommet stress reducer that is lightweight and easy and inexpensive to manufacture.

These objects are attained by providing a grommet stress reducer comprising a stress distributing member having a recess formed in one surface thereof and a loop mounted thereon at said recess and extending outwardly therefrom. The recess is sized for receipt of a grommet secured around an attachment hole of a flexible covering and presents a rounded surface at its perimeter to prevent the grommet from becoming pinched or collapsing. The stress distributing member may form a bar to reduce stress on an end or side grommet or may form a semi-circular wedge to reduce stress on a corner grommet. The loop receives a securing rope or other tie therethrough. The force on the loop is distributed by the bar or wedge over an extended portion of the flexible covering. A combination of bar and wedge stress distributing members forms a system for reducing stress on the plurality of grommets within a flexible covering, such as a tent or tarp.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 5 is a top plan view of a second embodiment of a grommet stress reducer in accordance with the present invention;

FIG. 6 is an end elevation of the grommet stress reducer of FIG. 5;

FIG. 7 is a front elevation of the grommet stress reducer of FIG. 5;

FIG. 8 is a rear elevation view of the grommet stress reducer of FIG. 5;

FIG. 9 is a bottom plan view of the grommet stress reducer of FIG. 5.

DETAILED DESCRIPTION OF THE PREFERRED EMBODIMENT

Figure 10:
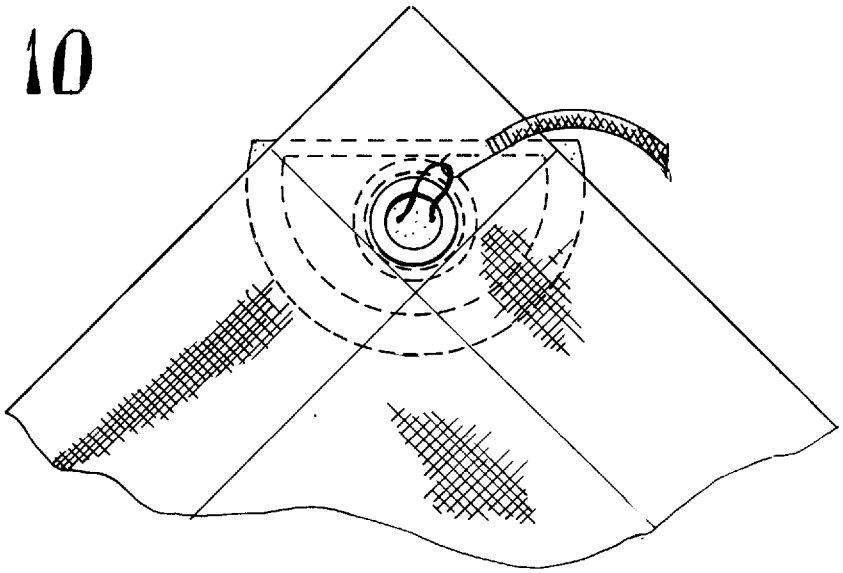
FIG. 10 is a top view of the grommet stress reducer of FIG. 5 showing a corner grommet of a tarp mounted therein.

A grommet stress reducer 10, as in FIGS. 1–4, reduces the stress applied to the grommets 11 at anchoring hole of flexible coverings, such as tarp 12 when installed to cover a load or otherwise. See FIGS. 4 and 10. "Grommet" as used herein is meant to include any grommet, eyelet or other type of reinforcing ring used with flexible coverings, such as tents or tarps.

Grommet stress reducer 10 includes stress distributing member 14*a* or 14*b*. Members 14*a* and 14*b* differ only in shape. Stress distributing member 14*a* is shown in FIGS. 1–4 and is shaped to present an elongated bar member. Bar member 14*a* is used to reduce the stress on a grommet 11 located along the side or end of a tarp 12. See FIG. 4. Stress distributing member 14*b* is shown in FIGS. 5–10 and presents a semi-circular wedge. Wedge member 14*b* includes a linear edge 16 and an arcuate edge 18. It is used to reduce the stress on a grommet 11 located at the corner of tarp 12. See FIG. 10. Edge 18 is curved or arcuate to help prevent tarp from ripping.

Bar and wedge members 14*a* and 14*b* are substantially rigid. Bar and wedge member 14*a* and 14*b* are also preferably lightweight and thus formed of a material such as wood, plastic or graphite. Also, the outer surface 16 of bar and wedge members 14*a* and 14*b* should be coated with a non-slip substance such as rubber, plastic or silicon. Of course, alternatively, bar and wedge members 14*a* and 14*b* may be formed of such a non-slip material.

Bar and wedge members 14*a* and 14*b* have a recess 26 formed therein with a connecting member or loop 28 mounted on the member 14*a* or 14*b* at recess 26. Recess 26 is shaped to correspond to the shape of a grommet 11, so typically, recess 26 is circular. Recess 26 is formed in the outer surface 20 of bar and wedge members 14*a* and 14*b*. On bar member 14*a*, recess 26 is centered between the ends 22 of bar member 14*b* and spaced apart from the bar member's sides 24, as in FIG. 1. On wedge member 14*b*, recess 26 is centered between the ends of linear edge 16 and spaced apart from linear edge 16 and arcuate edge 18, as in FIG. 5.

Recess 26 presents a rounded or arcuate surface or wall 30 at its perimeter. See FIGS. 2 and 7–8. Recess 26 is also sized to receive a grommet 11 therein. Thus, recess 26 preferably has a diameter substantially equal to or slightly larger than the diameter of grommet 11 and has a depth substantially equal to the height of grommet 11. See FIGS. 2, 4 and 10.

Figure 1:
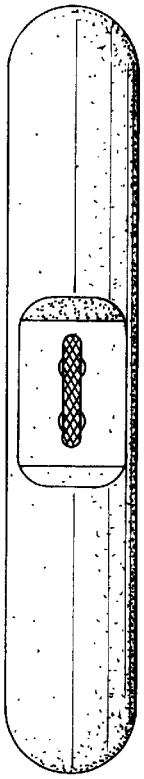
FIG. 1 is a top plan view of a first embodiment of a grommet stress reducer in accordance with the present invention.
Figure 2:
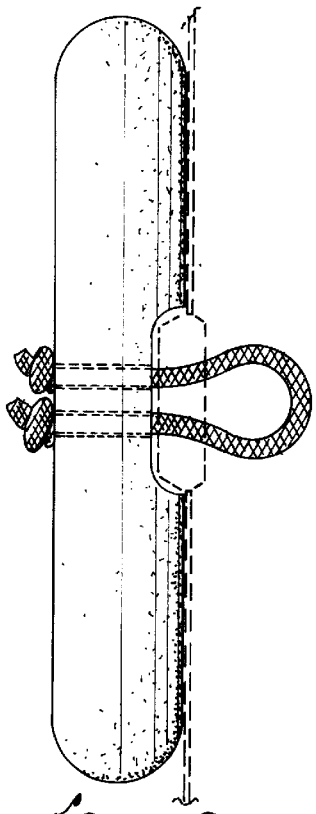
FIG. 2 is a side elevation view of the grommet stress reducer of FIG. 1 with a grommet shown seated within the recess in phantom lines.
Figure 3:
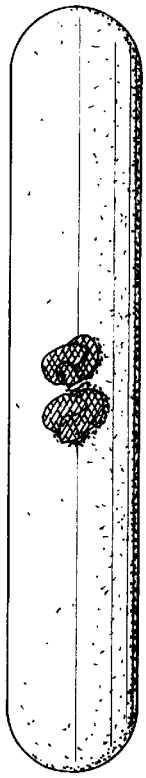
FIG. 3 is a bottom plan view of the grommet stress reducer of FIG. 1.
Figure 4:
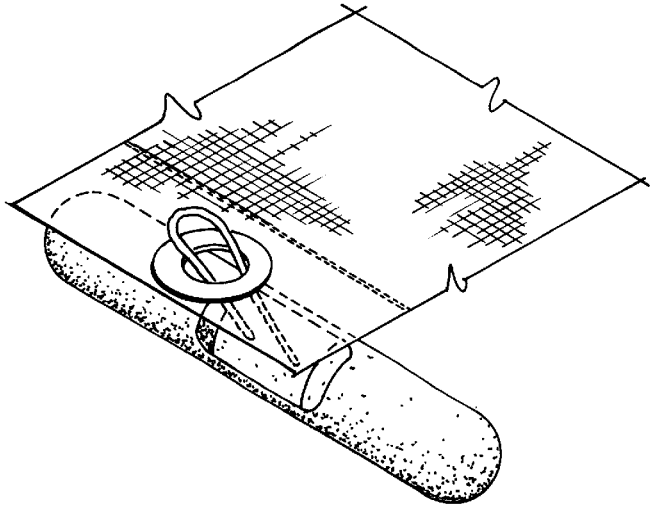
FIG. 4 is a perspective view of the grommet stress reducer of FIG. 1 showing a side grommet of a tarp being mounted therein.

Loop 28 is securely mounted to member 14*a* and 14*b* to extend outwardly from within recess 26. Loop 28 can be flexible or rigid. It receives a tie, rope or other cover securing means therethrough. See FIG. 10. As best seen in FIGS. 2, 7–8, loop 28 is formed of rope. The ends of the rope or other flexible loop material extend through member 14*a* or 14*b* at recess 26 and are knotted to secure the loop 28 to member 14*a* and 14*b*.

OPERATION

In operation, a bar or wedge member 14*a* or 14*b* is positioned behind tarp 12 with its loop 28 extending through each anchoring hole around which a grommet 11 is secured. See FIGS. 4 and 10. More specifically, a bar member 14*a* is positioned behind each side or end grommet 11, and a wedge member 14*b* is positioned behind each corner grommet 11.

The grommet 11 seats itself in the recess 26 on the side of the bar or wedge member 14*a* or 14*b* from which the loop 28 projects. Accordingly, when a rope or other tie member 34 is fed through each loop to secure the tarp 12, each grommet 11 is seated and held within its corresponding recess 26. The rounded surface 30 around each recess 26 prevents each grommet 11 from becoming pinched or collapsing. Also, because the height of each grommet 11 is substantially equal to the depth of its corresponding recess 26, grommets are substantially flush with the outer surface 20 of each corresponding bar or wedge member 14*a* or 14*b*, The force on each loop 28 is distributed by the corresponding bar or wedge member 14*a* or 14*b* over an extended portion or area of the tarp 12. In this manner, the force is distributed over a wider area and the chance of failure is minimized. See FIGS. 4 and 10.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A grommet stress reducer comprising:

a stress distributing member having a recess formed in one surface thereof;

a connecting member mounted on said stress distributing member at said recess and extending outwardly therefrom;

said recess being sized for receipt of a grommet therein and presenting a rounded surface at its perimeter to prevent the grommet from becoming pinched or collapsing;

said stress distributing member being a substantially rigid, light-weight bar with a non-slip outer surface for reducing stress on an end or side grommet.

2. A grommet stress reducer as claimed in claim 1 wherein said recess has a depth substantially equal to the grommet's height.

3. A grommet stress reducer as claimed in claim 1 wherein said recess is substantially centered between ends of said stress distributing member and is spaced apart from sides of said stress distributing member.

4. A grommet stress reducer as claimed in claim 1 wherein said connecting member is a flexible loop.

5. A grommet stress reducer, comprising:

a stress distributing member having a recess formed in one surface thereof;

a connecting member mounted on said stress distributing member at said recess and extending outwardly therefrom;

said recess being sized for receipt of a grommet therein and presenting a rounded surface at its perimeter to prevent the grommet from becoming pinched or collapsing;

said stress distributing member being a substantially rigid, light-weight and is semi-circular wedge with a non-slip surface for reducing stress on a corner grommet.

6. A grommet stress reducer as claimed in claim 5 wherein said recess has a depth substantially equal to the grommet's height.

7. A grommet stress reducer as claimed in claim 5 wherein said recess is substantially centered between ends of said stress distributing member and is spaced apart from sides of said stress distributing member.

8. A grommet stress reducer as claimed in claim 5 wherein said connecting member is a flexible loop.

9. A system for reducing stress on the grommets of a flexible covering, comprising:

a plurality of stress distributing members, each said member having a recessed surface formed therein for receipt of a grommet and a connecting member securely mounted to each said stress distributing member at said recessed surface and extending outwardly therefrom;

at least one said member forming a bar for reducing stress on an end or side grommet;

a rounded surface extending from each said recessed surface to a top surface of each said stress distributing member to prevent the grommet from becoming pinched or collapsing.

10. A system as claimed in claim 9 wherein at least one said member forms a semi-circular wedge for reducing stress on a corner grommet.

11. A system as claimed in claim 9 wherein each said recess has a depth substantially equal to a grommet's height.

12. A system as claimed in claim 9 wherein each said stress distributing member is substantially rigid and light-weight with a non-slip outer surface.

13. A system as claimed in claim 9 wherein each said recess is substantially centered between ends of said corresponding stress distributing member and is spaced apart from sides of said corresponding stress distributing member.

14. A system for reducing stress on the grommets of a flexible covering, comprising:

a plurality of stress distributing members, each said member having a recess formed in an outer surface thereof and a connecting loop mounted on each said member at said recess and extending outwardly therefrom;

at least one said member forming a bar for reducing stress on an end or side grommet and at least one said member forming a semi-circular wedge for reducing stress on a corner grommet;

each said recess being sized for receipt of a grommet therein in presenting a rounded surface at its perimeter, to prevent the grommet from becoming pinched or collapsing.

15. A system for reducing stress on the grommets of a flexible covering as claimed in claim 14 wherein each said recess has a depth substantially equal to a grommet's height.

16. A system for reducing stress on the grommets of a flexible covering as claimed in claim 14 wherein each said recess is substantially centered between ends of said corresponding member and is spaced apart from sides of said corresponding stress distributing member.

* * * * *